US007194233B2

(12) United States Patent
Wu et al.

(10) Patent No.: US 7,194,233 B2
(45) Date of Patent: Mar. 20, 2007

(54) VARIABLE POWER FUSER EXTERNAL HEATER

(75) Inventors: Fangsheng Wu, Rochester, NY (US); Muhammed Aslam, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 11/117,559

(22) Filed: Apr. 28, 2005

(65) Prior Publication Data

US 2006/0245796 A1 Nov. 2, 2006

(51) Int. Cl.
*G03G 15/20* (2006.01)

(52) U.S. Cl. ..... 399/328; 399/329

(58) Field of Classification Search ..... 399/328, 399/320, 329, 330, 331; 219/216, 619
See application file for complete search history.

(56) References Cited

U.S. PATENT DOCUMENTS

| | | | | |
|---|---|---|---|---|
| 6,321,061 | B1 * | 11/2001 | Sonobe et al. | 399/329 |
| 6,868,251 | B2 * | 3/2005 | Pirwitz | 399/329 |
| 7,010,255 | B2 * | 3/2006 | Yura et al. | 399/328 |
| 2005/0214043 | A1 * | 9/2005 | Kameda | 399/328 |
| 2005/0226660 | A1 * | 10/2005 | Fuma | 399/328 |

* cited by examiner

*Primary Examiner*—Hoan Tran
(74) *Attorney, Agent, or Firm*—Lawrence P. Kessler

(57) ABSTRACT

An external heater for a fuser assembly for a reproduction apparatus. The fuser assembly includes a fuser member for fusing a marking particle image to a receiver member. The external heater has a heat transfer surface adapted to be selectively engaged with the fuser member, and a device for heating said heat transfer surface. A mechanism is provided for engaging a variable portion of the heat transfer surface with the fuser member to selectively change the amount of heat transferred from the heating device to the fuser member through the heat transfer surface.

2 Claims, 8 Drawing Sheets

VARIABLE POWER FUSER EXTERNAL HEATER

FIELD OF THE INVENTION

This invention relates in general to a fuser assembly for an electrographic reproduction apparatus, and more particularly to a variable power external heater for a fuser assembly to effectively regulate the fuser temperature according to the media type being fused.

BACKGROUND OF THE INVENTION

In typical commercial reproduction apparatus (electrostatographic copier/duplicators, printers, or the like), a latent image charge pattern is formed on a uniformly charged charge-retentive or photoconductive member having dielectric characteristics (hereinafter referred to as the dielectric support member). Pigmented marking particles are attracted to the latent image charge pattern to develop such image on the dielectric support member. A receiver member, such as a sheet of paper, transparency or other medium, is then brought into contact with the dielectric support member, and an electric field applied to transfer the marking particle developed image to the receiver member from the dielectric support member. After transfer, the receiver member bearing the transferred image is transported away from the dielectric support member, and the image is fixed (fused) to the receiver member by heat and pressure to form a permanent reproduction thereon.

One type of fuser assembly for typical electrographic reproduction apparatus includes at least one heated roller, having an aluminum core and an elastomeric cover layer, and at least one pressure roller in nip relation with the heated roller. The fuser assembly rollers are rotated to transport a receiver member, bearing a marking particle image, through the nip between the rollers. The pigmented marking particles of the transferred image on the surface of the receiver member soften and become tacky in the heat. Under the pressure, the softened tacky marking particles attach to each other and are partially imbibed into the interstices of the fibers at the surface of the receiver member. Accordingly, upon cooling, the marking particle image is permanently fixed to the receiver member.

A typical roller fuser assembly of the prior art is shown in FIG. 1. The roller fuser assembly 10 includes a fuser roller 12, a pressure roller 14, and other necessary sub-systems and components (not shown). The roller 12 (or both rollers 12 and 14) is heated internally (for example by lamps 16, 18), and/or externally for example by heat rollers 20 (as shown in FIG. 2), to pre-set temperatures. When fusing prints on receiver members S, the rollers 12 and 14 are pressed together to form a nip, and rotation of the rollers drive prints through the nip. In the nip, heat energy stored in the fuser roller 12 is transferred to the prints, and heats up and melts the toner image carried by the receiver member. Under the temperature and pressure, the toner is fixed on the receiver member.

The configuration of the fuser roller 12 can greatly affect the receiver member release characteristics and heat transfer of the fuser. Generally the fuser roller 12 has a metal core 22, a base cushion 24, and a thin release topcoat 26. A thicker base cushion makes release geometry in the nip area more favorable for the receiver member to be released from the fuser roller 12, but makes the heat more difficult to transfer from the core 22 to the outer surface of the topcoat 26.

To preserve the favorable release geometry and improve the heat transfer characteristics, some kind of external heaters are often used. FIG. 2 shows a fuser with one or two roller external heaters 20, with heating lamps 30 inside. The metal external heating rollers 20 have high thermal conductivity and can transfer higher amount of heat than other external heating methodologies, such as radiation heating. They are also simple, less expensive, and present less potential fire hazards. However, since the external heating rollers 20 usually have small diameter, it is difficult to provided a large nip between an external heating roller and a fuser roller. This limits the heat transfer rate between an external heating roller 20 and a fuser roller 12. Furthermore, a high force between the external heating roller 20 and the fuser roller 12, may cause wear and damage to the fuser roller topcoat 26.

SUMMARY OF THE INVENTION

It is the purpose of the invention to improve the heat transfer rate, and to reduce the force applied to a fuser roller having an external heater. Accordingly, this invention provides an external heater for a fuser assembly for a reproduction apparatus. The fuser assembly includes a fuser member for fusing a marking particle image to a receiver member. The external heater has a heat transfer surface adapted to be selectively engaged with the fuser member, and a device for heating said heat transfer surface. A mechanism is provided for engaging a variable portion of the heat transfer surface with the fuser member to selectively change the amount of heat transferred from the heating device to the fuser member through the heat transfer surface.

BRIEF DESCRIPTION OF THE DRAWINGS

In the detailed description of the preferred embodiments of the invention presented below, reference is made to the accompanying drawings, in which.

DETAILED DESCRIPTION OF THE INVENTION

Figure 3:
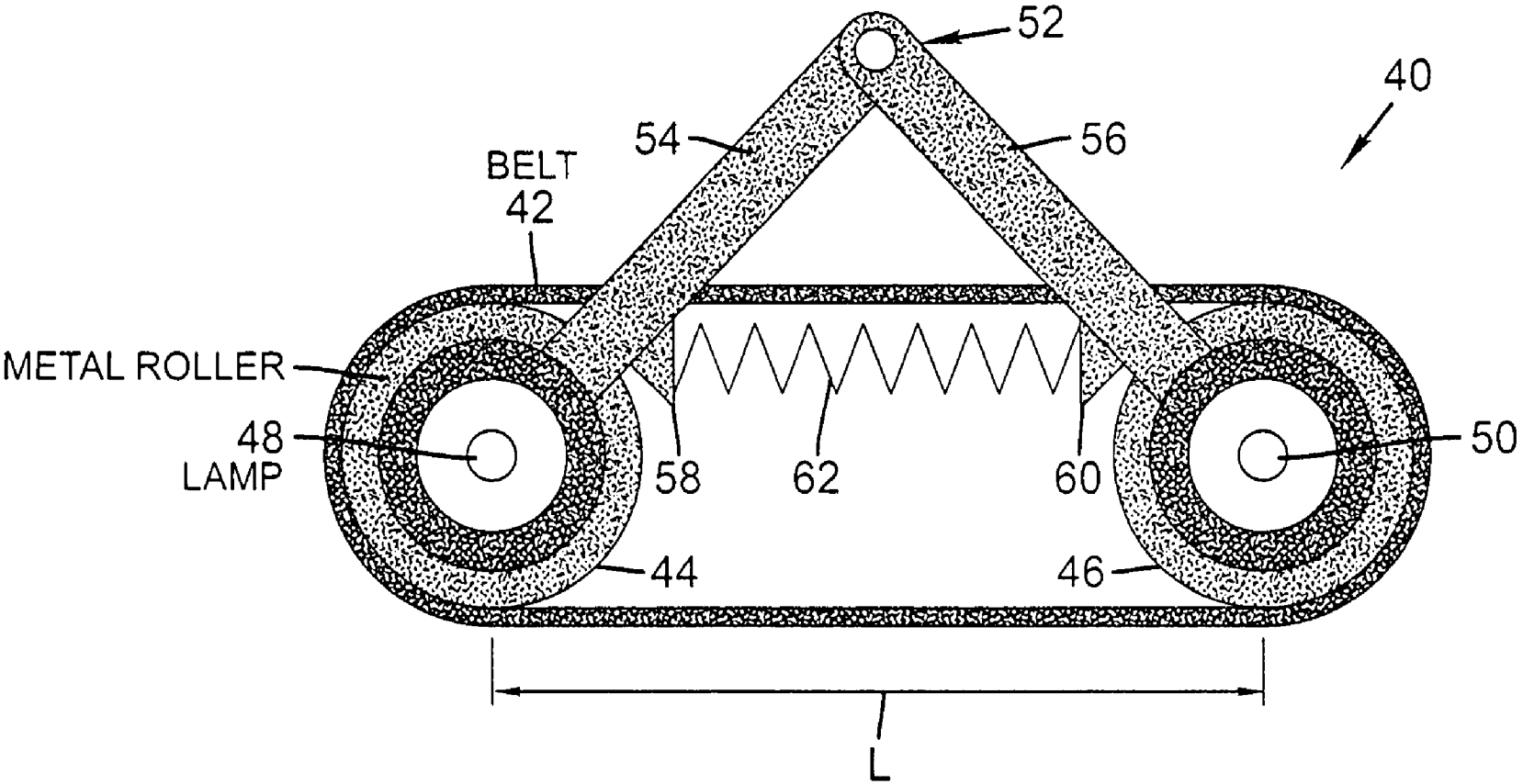
FIG. 3 is a side elevational view of a belt external heater according to this invention.

Referring now to the accompanying drawings, FIG. 3 shows a belt external heater, according to this invention, for a roller fuser assembly. The belt external heater, designated generally by the numeral 40, has a metal belt 42, entrained about two metal rollers 44, 46. The rollers 44, 46 have heater lamps 48, 50 coaxially disposed inside the rollers respectively. A linkage 52 is provided to keep the belt 42 in operative contact with the rollers 44, 46. The linkage 52 necessary to keep the belt in proper operative relation with the rollers 44, 46 includes a pair of pivotally interconnected arms 54, 56 connected at the free ends to the rollers 44, 46. The arms 54, 56 have respective seats 58, 60 that support a compression spring 62. The compression spring 62, or any other suitable mechanism, is used to urge the rollers 44, 46 in a direction to maintain the belt 42 under tension.

Figure 7:
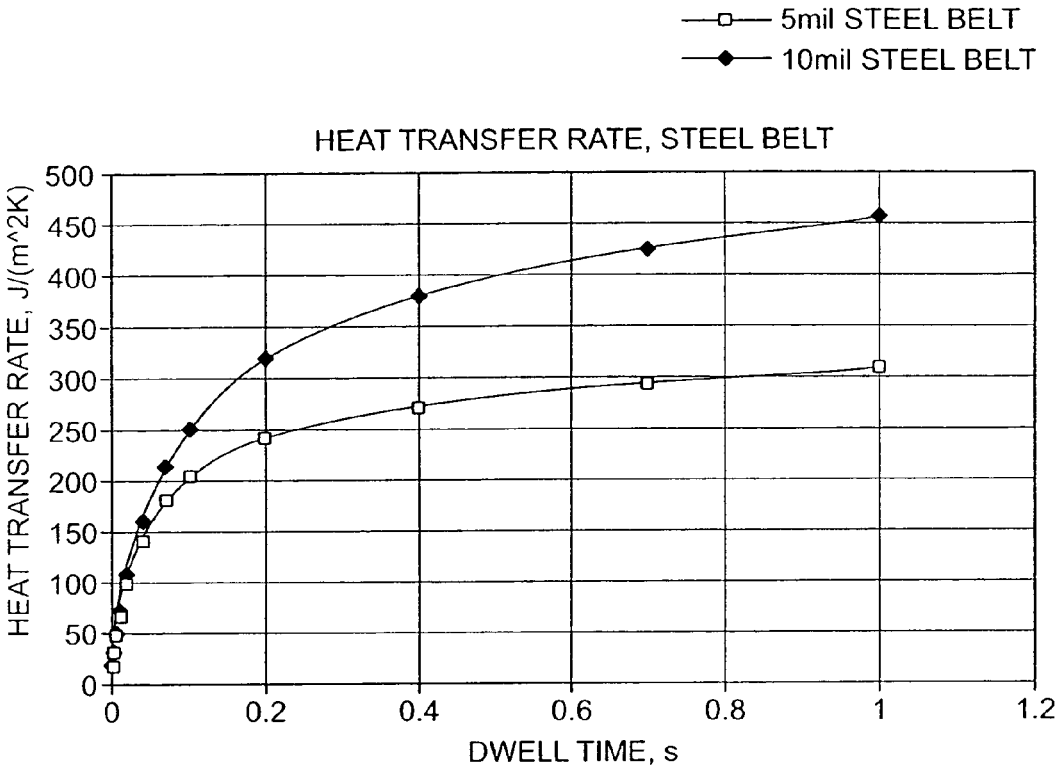
FIG. 7 is a graph depicting heat transfer rate for the belt external heater according to this invention plotted against dwell time.

The heat transfer rate for a sample of the belt external heater 40 according to this invention is shown in the graph of FIG. 7. Two representative belt thickness values have been included. The metal belt 42, according to this invention, has a thermal conductivity k in the range of about 1 to 250 Btu/(hr ft F), and preferably >20 Btu/(hr ft F). The thickness of the belt 42 is in the range of about 0.1 to 20 mils, and preferably 5 to 10 mils. The outer surface of the belt 42, which contacts the fuser roller assembly 10, preferably has a chrome coating and is polished such that the roughness of the belt is better than 0.1 μm Ra.

The desired contact length for the belt 42 to the fuser roller 12 is determined in the following manner. First, the maximum heat transfer rate needed for the fuser roller is determined. The dwell time DT, from for example FIG. 7, is then determined. The contact length L is calculated according to the formula:

$$L=DT\cdot V$$

where V is the fuser roller surface speed. The whole belt length can then be determined from L by geometry calculations.

The belt external heater 40 can deliver variable power between 0 and a maximum value $P_{max}$ to the fuser roller. The heat power P transferred from the external heater to the fuser roller has the following relationship with the heat transfer rate R, the belt width W, the fuser roller surface speed V, and the temperature difference ΔT between the belt and the fuser roller:

$$P=R\cdot W\cdot V\cdot \Delta T$$

The belt width W and the fuser roller surface speed V are design constants, and the temperature difference ΔT between the belt 42 and the fuser roller 12 is a process constant. Therefore, changing R will change P. In this example of the preferred embodiment of this invention, the heat transfer rate R of the proposed external heater can be improved to 300 to 450 J/(m2 K).

Figure 4A:
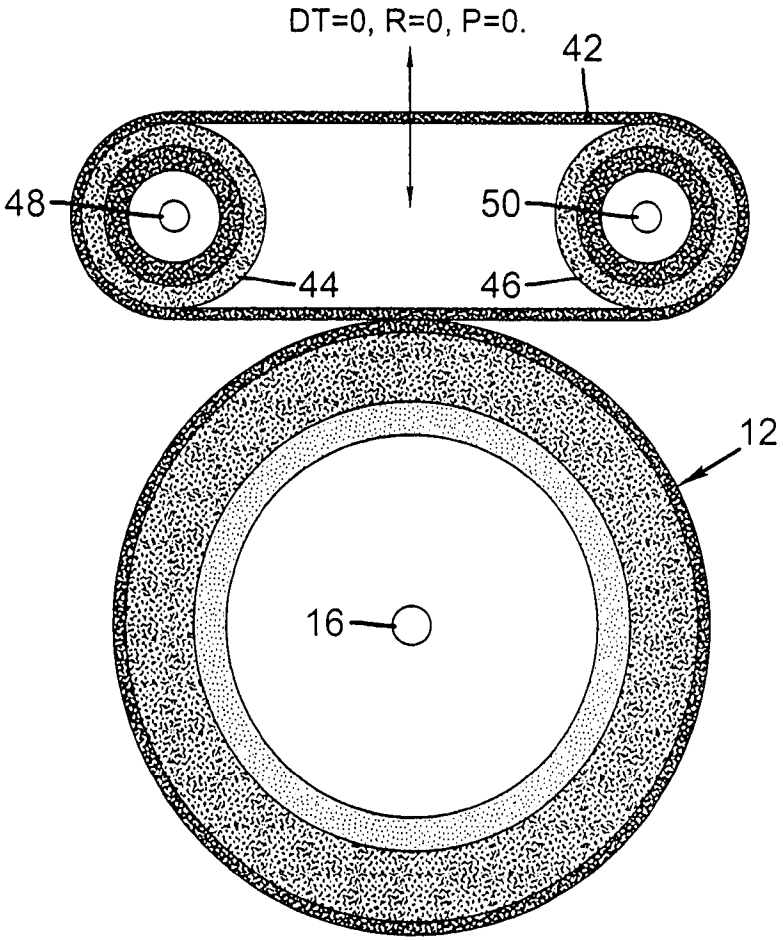
FIG. 4*a* is a side elevational view of a belt external heater according to this invention in a stand-by relation with a fusing roller.
Figure 4B:
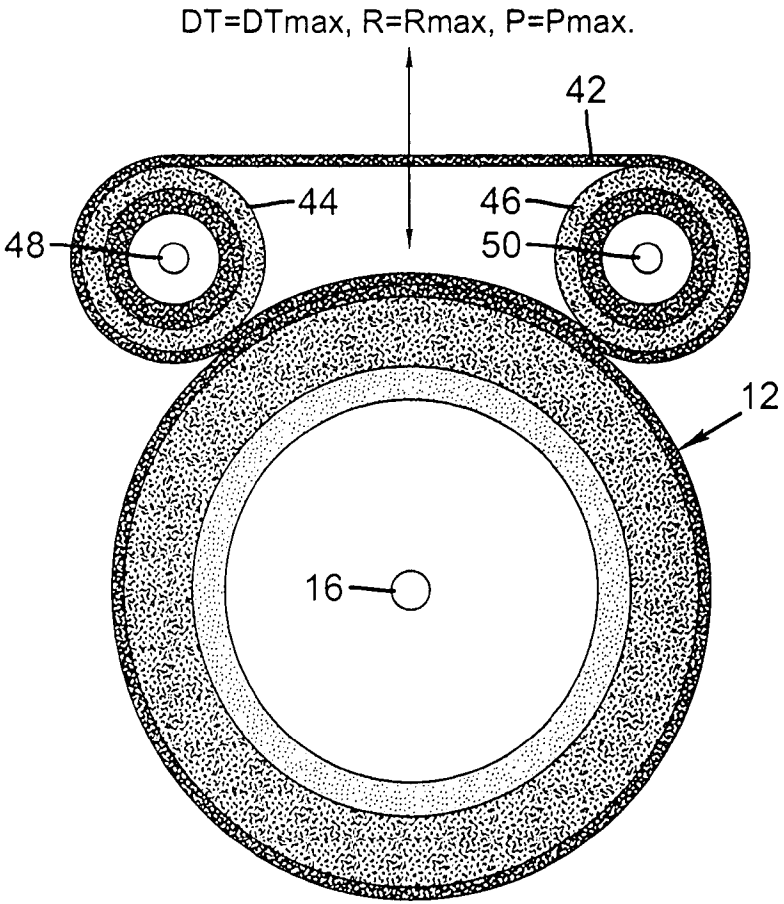
FIG. 4*b* is a side elevational view of the belt external heater of FIG. 4*a* in the operative relation with the fusing roller.
Figure 5B:
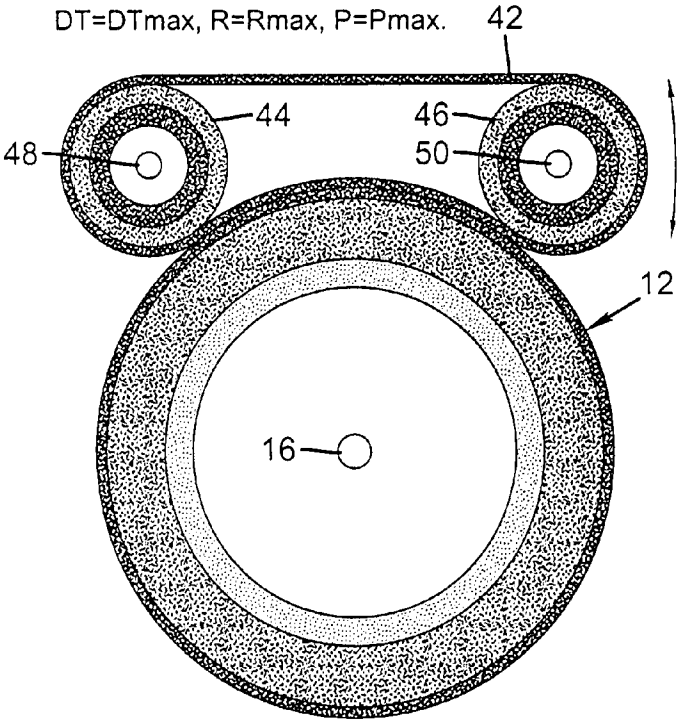
FIG. 5*b* is a side elevational view of the alternate arrangement of the belt external heater of FIG. 5*a* in the operative relation with the fusing roller.
Figure 5A:
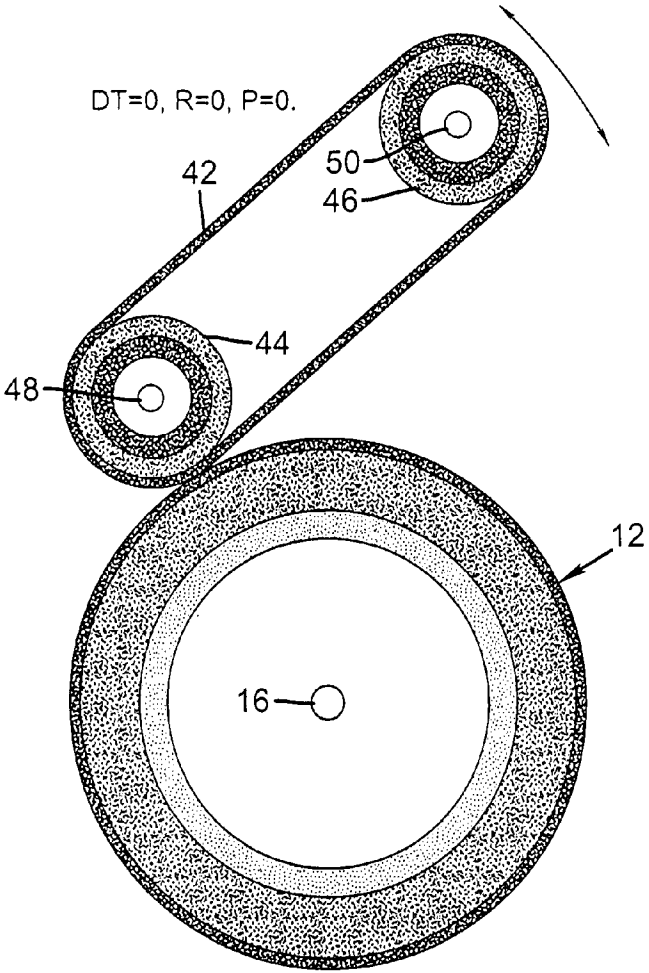
FIG. 5*a* is a side elevational view of an alternate arrangement for a belt external heater according to this invention in a stand-by relation with a fusing roller.

Referring to FIGS. 4*a*, 4*b*, and 5*a*, 5*b*, two arrangements for the belt external heater 40 according to this invention are shown for variable power delivery to the fusing roller 12. In FIG. 4*a*, the external heater is placed symmetrically relative to the fuser roller 12. As shown in FIG. 4*b*, the entire heater 40 is movable towards or away from the fuser roller 12. The belt contact length can then be changed from 0 to a maximum value, letting DT change from 0 to $DT_{max}$ and P from 0 to $P_{max}$. In FIG. 5*a*, one heating roller (for example roller 44) is fixed about its longitudinal axis so as to be just touching the fuser roller 12, and the other roller (for example roller 46) can be moved about the longitudinal axis of the first roller, as shown in FIG. 5*b*. Similarly the belt contact length can be changed from 0 to a maximum value resulting in the heat transfer power P changing from 0 to $P_{max}$. The selection of the actual dwell time DT and heat transfer power P for desired control of the belt external heater 40 can be accomplished based on the information of the receiver member and image content to be fused, based on the fuser roller temperature and like, or a combination of above two.

Figure 6:
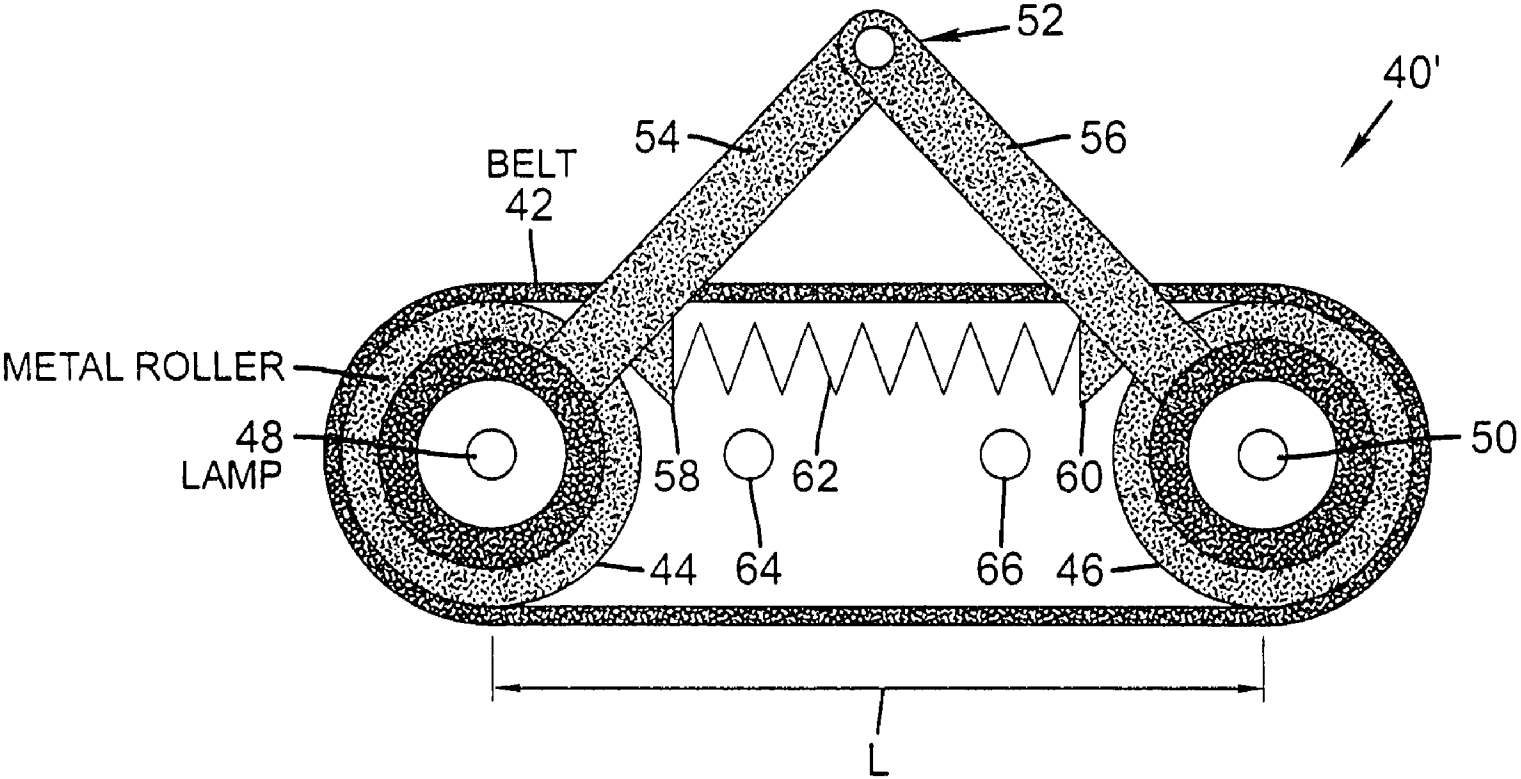
FIG. 6 is a side elevational view of another alternate embodiment of a belt external heater according to this invention.

In an alternate embodiment of the belt external heater according to this invention, designated by the numeral 40' in FIG. 6, extra lamp(s) 64, 66 can be included inside the belt loop to further increase the heat power transfer capability.

Figure 1:
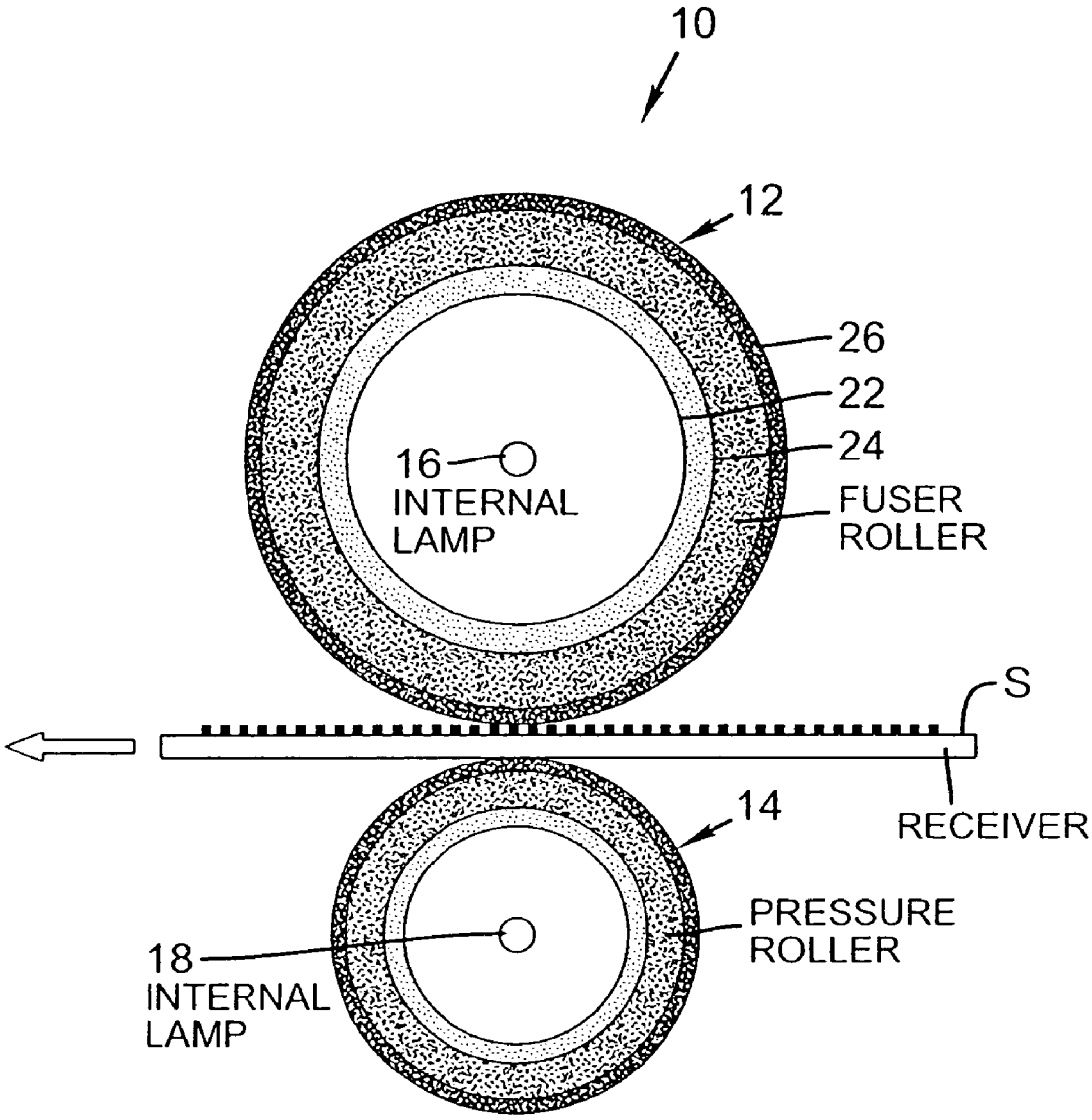
FIG. 1 PRIOR ART
FIG. 1 is a side elevational view of a typical internally heated roller fuser assembly of the prior art.
Figure 2:
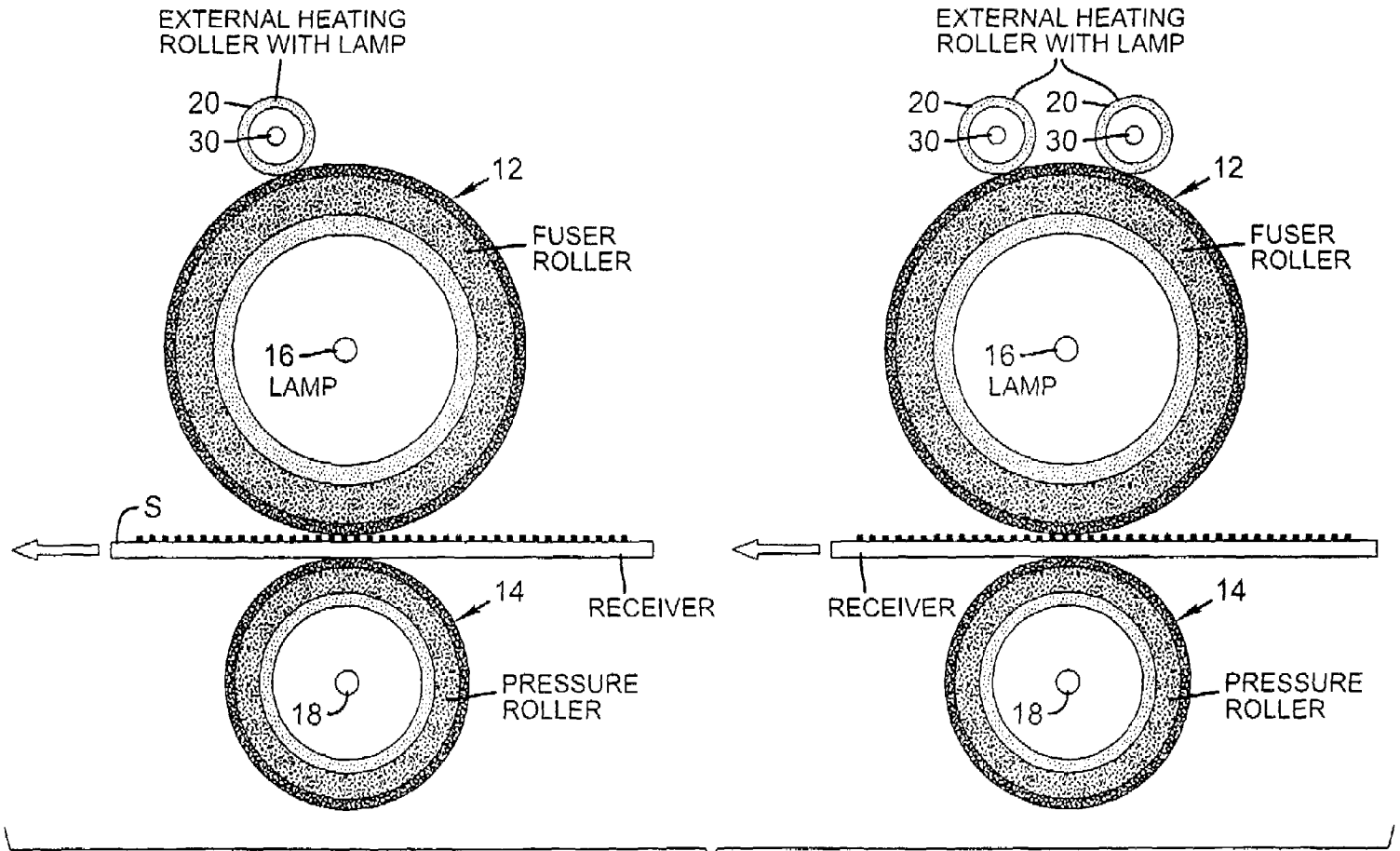
FIG. 2 PRIOR ART
FIG. 2 is a side elevational view of a typical externally heated roller fuser assembly of the prior art.
Figure 8:
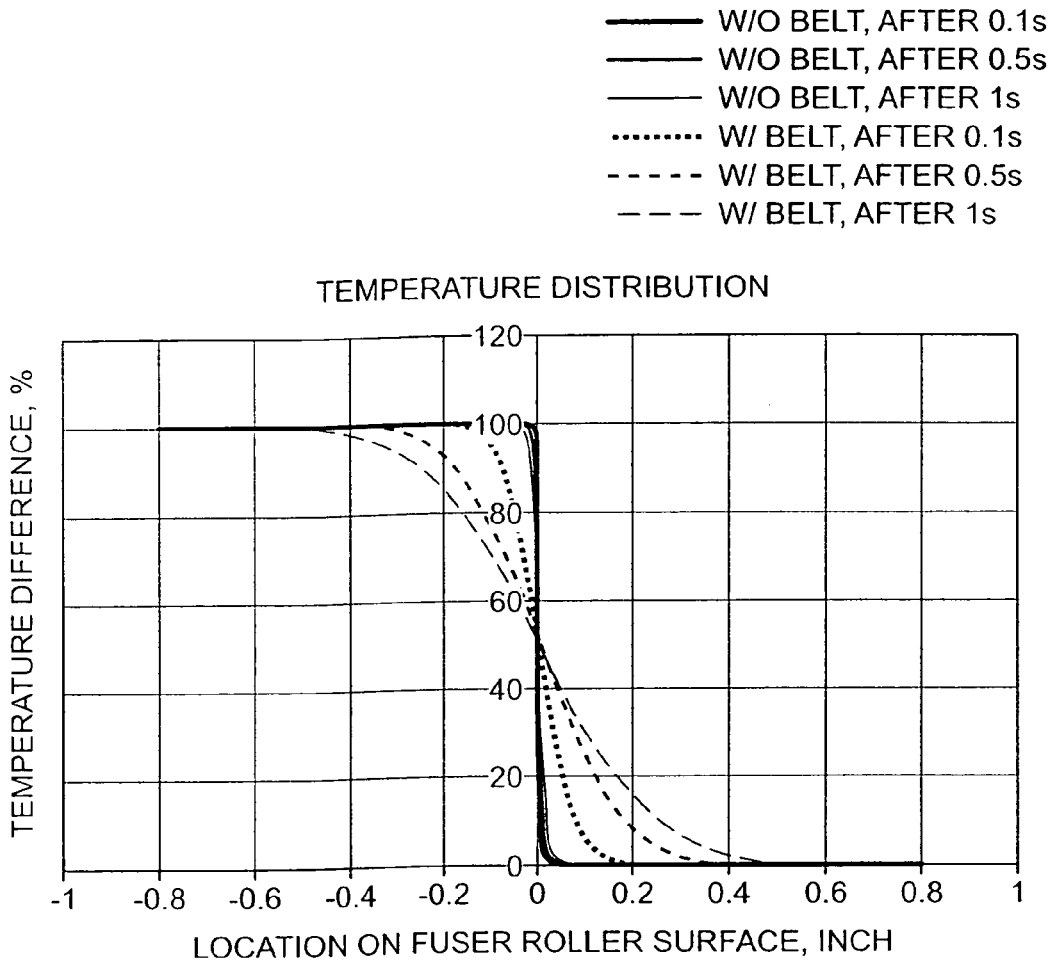
FIG. 8 is a graph depicting temperature change on the surface of a fuser roller with, or without, engagement with a belt external heater according to this invention.

An additional aspect of this invention is that the high thermal conductivity of the metal belt 42 can also be used to help to reduce the inter-frame temperature unevenness. The space between two successive receiver members in transport is called the "inter-frame". During the interframe, the fuser roller 12 contacts the pressure roller 14 (see FIG. 1) and transfers less heat out of the fuser assembly 10. Therefore, the portion of fuser roller surface at the interframe has a higher temperature than that portion of the fusser roller contacting the receiver member. When this higher temperature portion of fuser roller surface contacts the next print receiver member, the higher temperature may cause a higher gloss for the fused toner image. Typically, if this gloss difference is gradual, one will not be able to see it. However, the sudden temperature change at the receiver member's lead and/or trail edge highlights this gloss difference and makes it a noticeable and objectionable gloss artifact. The high thermal conductivity metal belt 42 helps to dissipate this temperature difference more quickly, thus reducing or altogether eliminating such gloss artifact. The graph of FIG. 8 compares the temperature diffusing on the fuser roller surface with or without the metal belt after 0.1, 0.5, and 1 second. That is, after 0.5 seconds of dwell time, the temperature difference starts diffusing within 0.5 inches apart, and makes a gradual temperature change on the fuser roller surface. If the belt external heater 40 according to the present invention were to be used solely for reducing the inter-frame gloss artifact, a dwell time >0.1 seconds is needed.

Thus, the principle advantages of the belt external heater according to this invention include the transfer of much higher thermal power to the fuser assembly 10 roller, deliverability of variable power to the fuser roller 12, and the reduction or elimination of the inter-frame gloss artifact.

The invention has been described in detail with particular reference to certain preferred embodiments thereof, but it will be understood that variations and modifications can be effected within the spirit and scope of the invention.

PARTS LIST

10 Roller fuser assembly
12 Fuser roller
Pressure roller
16, 18 Lamps
20 Heat roller
22 Metal core
24 Base cushion
26 Release topcoat

30 Heating lamps
40 Belt external heater
40' Belt external heater
42 Metal belt
44, 46 Metal rollers
48, 50 Heater lamps
52 Linkage
54, 56 Arms
58, 60 Seats
62 Compression spring
64, 66 Lamps
S Receiver member

What is claimed is:

1. A fuser assembly for a reproduction apparatus, said fuser assembly including a fuser member for fusing a marking particle image to a receiver member, and an external heater for said fuser member, said external heater comprising:

a heat transfer member, adapted to be selectively engaged with said fuser member, said heat transfer member including an elongated belt supported by spaced rollers, so as to define a closed loop path for said elongated belt, said spaced rollers being urged in a direction to maintain a desired tension on said elongated belt;

a device for heating said heat transfer member; and a mechanism for engaging a variable portion of said elongated belt of said heat transfer member with said fuser member to selectively change the amount of heat transferred from said heating device to said fuser member through said elongated belt, said engaging mechanism selectively moving said spaced rollers relative to said fuser member so as to vary the length of said elongated belt in engagement with said fuser member.

2. The external heater according to claim 1, wherein said engaging mechanism retains one of said spaced rollers in a fixed relation to said fuser member and selectively pivots the other of said spaced rollers about the axis of said fixed spaced roller so as to vary the length of said elongated belt in engagement with said fuser member.

* * * * *